US007438093B2

(12) United States Patent
Maes et al.

(10) Patent No.: US 7,438,093 B2
(45) Date of Patent: Oct. 21, 2008

(54) SYMMETRICAL MEASUREMENT OF JAW

(75) Inventors: Dominique Maes, Wakken (BE); Jo Hullebusch, Vichte (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 753 days.

(21) Appl. No.: 10/830,427

(22) Filed: Apr. 23, 2004

(65) Prior Publication Data

US 2004/0238061 A1 Dec. 2, 2004

(30) Foreign Application Priority Data

Apr. 23, 2003 (BE) ..... 2003/0257

(51) Int. Cl.
*D03J 1/08* (2006.01)

(52) U.S. Cl. ..... 139/291 C

(58) Field of Classification Search ..... 139/7 F, 139/43, 107.4, 260, 263, 291 C
See application file for complete search history.

(56) References Cited

U.S. PATENT DOCUMENTS 3,877,119 A * 4/1975 Gierse et al. ..... 26/9
4,478,255 A * 10/1984 Juillard ..... 139/21
4,892,120 A * 1/1990 Bostyn ..... 139/21
5,826,624 A * 10/1998 Graser ..... 139/1 R

* cited by examiner

*Primary Examiner*—John Calvert
*Assistant Examiner*—Andrew W. Sutton
(74) *Attorney, Agent, or Firm*—James Creighton Wray; Clifford D. Hyra

(57) ABSTRACT

Cutting device for a face-to-face weaving machine, comprising a cutting knife and an upper (2) and a lower cutting rail (3) with an intermediate distance (13) which may be adjusted by means of one or several screw means (3, 7), the device comprising at least one first screw means (3) having a first (4) and a second threaded part with a mutually opposite screw thread having practically the same pitch, each threaded part (4, 5) being designed in order to move a respective cutting rail as to height in the opposite direction, because of which the almost central position of the cutting knife with respect to the upper (2) and the lower (1) cutting rail is maintained, with the same deviation, when adapting the adjusted height of the jaw to a new height of the jaw.

18 Claims, 2 Drawing Sheets

SYMMETRICAL MEASUREMENT OF JAW

This application claims the benefit of Belgian Application No. 2003/0257 filed Apr. 23, 2003.

BACKGROUND OF THE INVENTION

The present invention relates to a cutting device for a face-to-face weaving machine, comprising a cutting knife and an upper and a lower cutting rail with an intermediate distance which may be adjusted by means of one or several screw means.

By intermediate distance, in this patent application, is meant: the distance between the upper and the lower cutting rail (=jaw).

In face-to-face weaving machines two fabrics are woven simultaneously one above the other which most of the time are interconnected by pile warp yarns moving from the lower cloth to the upper cloth and inversely, forming the pattern.

The two fabrics are kept apart from one another at a distance determined by the opening between the lower and the upper rail, provided a sufficient tension is applied to the warp yarns. The face-to-face fabrics not yet separated are kept apart from one another at the distance between the upper and the lower cutting rail (=jaw), before being presented to the cutting movement.

Adjusting this intermediate distance (jaw) is a delicate operation, as much as:

- to adjust a certain value of the jaw;
- to keep the height of the jaw at the same value at the left and right of the weaving machine;
- to keep the cutting device in a central position with respect to the jaw.

In the Belgian patent BE 8.701.167 a device is described which simplifies the adjusting of the jaw and with which applying the "trial and error method" is no longer needed where after each readjustment the jaw has to be checked by weaving a piece of fabric. To that effect, the cutting device is provided with one or several electronic motion detecting devices giving a signal which is related to the position of the upper and the lower rail respectively with respect to the cutting knife. When readjusting the adjusting spindles, which, according to this patent, are driven by an electric motor, the distances between the upper and the lower cutting rail on the one hand and between one of the cutting rails and a fixed point of reference on the weaving machine (top or bottom side of the cutting knife) on the other hand, may be read and verified, or the processor unit may be operated to control the drive and, in doing so, to reach the position desired. On the one hand, the adjusting spindles used to that effect are adjusting spindles adjusting the height of the jaw (moving the upper cutting rail with respect to the lower cutting rail or inversely) and on the other hand, adjusting spindles moving the adjustment of the jaw with respect to the cutting rail (moving upper and lower cutting rails as a whole with respect to the cutting knife). The method emanating from this operation has the disadvantage that, when adjusting a new height of the jaw by moving the upper cutting rail with respect to the lower cutting rail (or inversely) the cutting knife will be moved from the centre of the jaw and has to be readjusted by means of other adjusting spindles. This method is laborious and may be the cause of errors.

The invention according to BE 8.701.167 also allows the upper and the lower cutting rail each to be equipped with one or several adjusting spindles allowing a movement between the cutting knife and the upper and the lower cutting rail respectively. In this embodiment, first the upper rail, for instance, is adjusted with respect to the cutting knife and thereafter the lower cutting rail is adjusted with respect to the cutting knife. This method also remains laborious, because both the upper and the lower cutting rail have to be adjusted separately. When adjusting the height of the jaw, the position of the cutting knife will not remain in the centre of the jaw and this may likewise be the cause of errors or inaccuracies.

Driving the adjusting spindles by means of electric motors and using the processor unit in order to reach the position desired, will simplify the adjustment and will reduce the risk of errors and inaccuracies, but it is an expensive solution for operations which have to be carried out only occasionally.

SUMMARY OF THE INVENTION

The purpose of the present invention is to produce a device and a method by which the almost central position of the cutting knife with respect to the upper and the lower cutting rail is maintained with the same deviation, when adapting the adjusted height of the jaw to a new height of the jaw.

The purpose of the invention is attained by providing a cutting device for a face-to-face weaving machine, comprising a cutting knife and an upper and a lower cutting rail having an intermediate distance which may be adjusted by means of one or several screw means, the device comprising at least one first screw means with a first and second threaded part, having a screw thread with practically the same pitch in opposite directions with respect to one another, each threaded part being designed to move a respective cutting rail as to height in opposite directions.

By almost the same pitch is meant that the nominal value of the thread of screw of the first and second threaded part is practically the same. Minor deviations, preferably under 0.1 mm are possible.

By turning the first screw means, for instance, by applying a spanner to a cross-section of the first screw means adapted to that purpose, the upper and the lower cutting rail will move for almost the same distance with respect to the cutting knife but in the opposite direction. In a preferred embodiment of the cutting device according to the invention, the said device comprises at least one second screw means to move the upper and the lower cutting rail as a whole, maintaining the intermediate distance.

By moving the whole of the upper and lower cutting rails with respect to the cutting knife, the upper and the lower rail may be adjusted symmetrically with respect to the cutting knife. This readjusting occurs by turning the second screw means, for instance, by means of a spanner applied to an adapted cross-section of the second screw means.

As readjusting the intermediate distance (the jaw) most of the time occurs at a low frequency and as, when weaving, great forces are applied to the upper and lower cutting rails, forces which are directly transferred to the adjusting spindles, preferably, one or several fastening plates are used to interconnect the upper and lower rails by means of tensioning means and the forces exerted on the upper and lower cutting rails during the weaving process are not transferred to the screw means.

In a particularly preferred embodiment of the cutting device according to the invention, the first screw means is made hollow and the second screw means extends through the hollow inner space of the first screw means. Preferably, the second screw means is provided with screw thread, so that when turning the second screw means, the upper and the lower rail together are moved upwards or downwards. Preferably, the first and second screw means each are provided with a clamping device to secure their positions on the one hand, and an adapted cross-section to which an adjusting spanner may be applied to adjust the jaw on the other hand.

In a more particular embodiment of the cutting device according to the invention, the device comprises at least one electric motor which is destined to drive the first and/or the second screw means in order to turn the first and/or the second screw means to adjust the cutting rails.

In a most particular embodiment of the cutting device according to the invention, the said cutting device is provided with at least one position sensor, which preferably is a contactless sensor, which will detect any position by means of, for instance, a laser beam.

Another object of this invention is a face-to-face weaving machine comprising a cutting device according to one of the claims 1 to 8.

In order to further clarify the properties of the present invention and to indicate its additional advantages and particulars, a more detailed description of the cutting device will now follow. It may be obvious that nothing in the following description may be interpreted as a restriction of the protection of the present invention demanded for in the claims.

BRIEF DESCRIPTION OF THE DRAWINGS

In this description, by means of reference numbers, reference is made to the attached drawings in which.

DETAILED DESCRIPTION OF THE PREFERED EMODIMENTS

Figure 1:
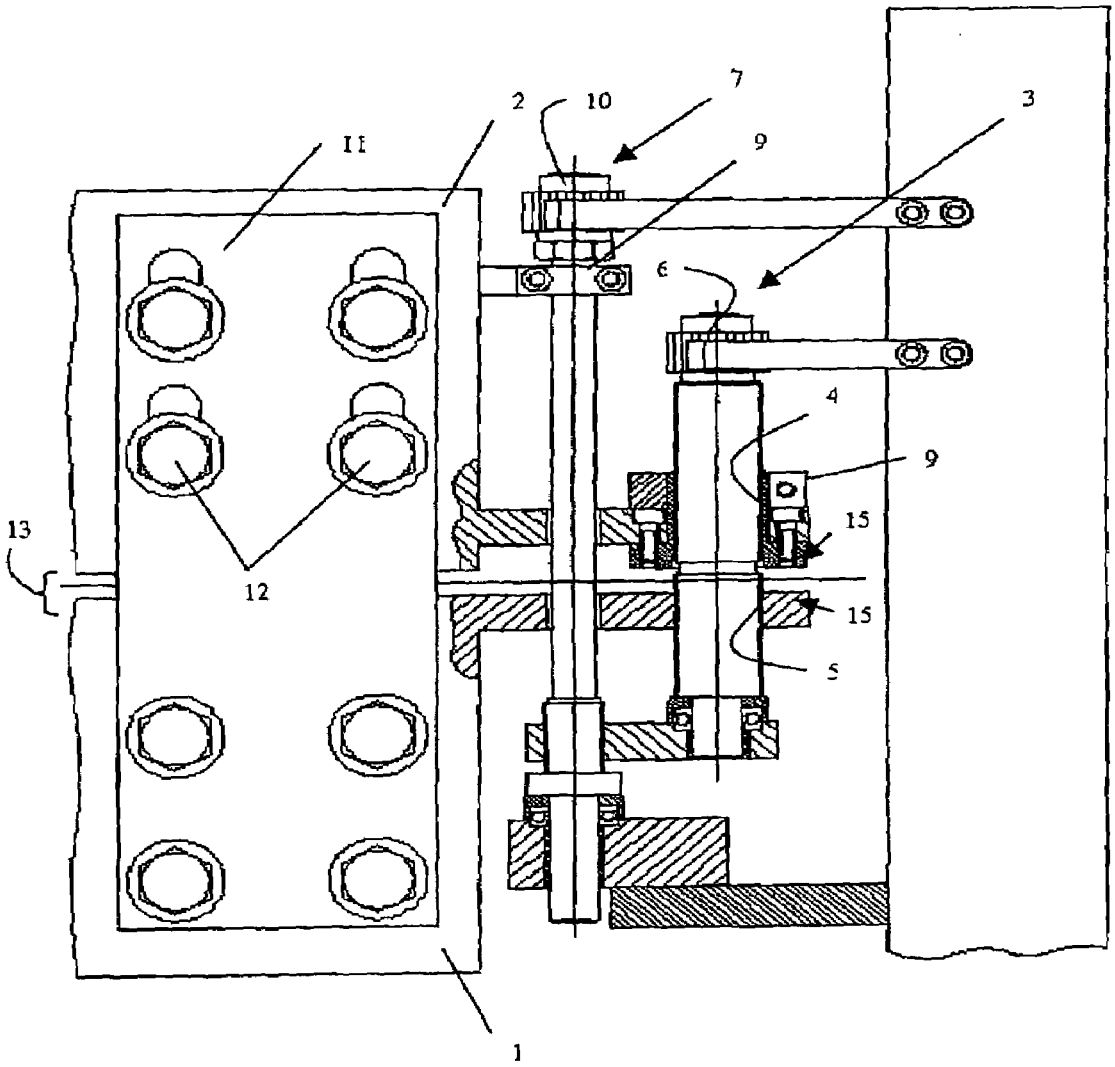
FIG. 1 is a representation of cutting device according to the invention with a first and a second screw means.
Figure 2:
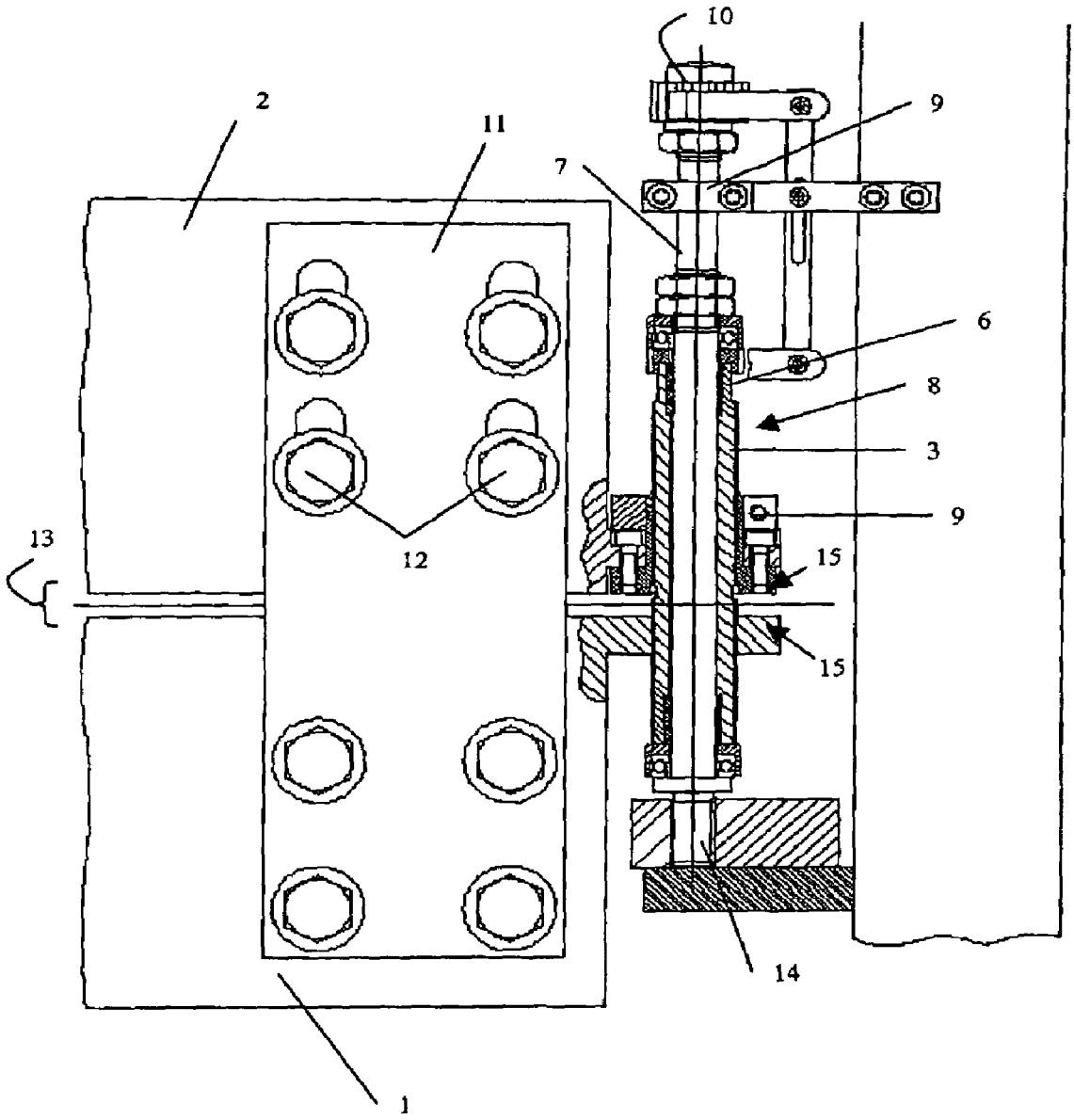
FIG. 2 is a representation of cutting device according to the invention in which the second screw means extends through the hollow inner space of the first screw means.

The cutting device of a face-to-face weaving machine represented in FIGS. 1 and 2 comprises an upper (2) and a lower cutting rail (1) with an intermediate distance (13) adjustable by means of one or several screw means (3, 7) and a cutting knife moving on a guiding which is rigidly connected to the machine framework. Left and right of the weaving machine a first screw means (3) is provided, moving both the lower cutting rail (1) and the upper cutting rail (2) along the same distance but in the opposite direction. Henceforth, the first screw means (3) will be indicated as the first adjusting spindle (3).

To that effect, each of these adjusting spindles (3) is provided with two threaded parts (4, 5), where the thread of the one part (4) is in the opposite direction to the thread of the other part (5) At the same time, the two threaded parts (4, 5) have the same pitch.

When this first adjusting spindle (3) is turned by applying an adjusting spanner to the adapted cross-section (6) (which may be, for instance, two parallel flattened sides of the adjusting spindle (3)), the upper (2) and the lower cutting rail (1) will move along the same distance with respect to the cutting knife, but in opposite directions. When carrying out this readjusting and after having finished the operation, the central position of the cutting knife is maintained with respect to the two cutting rails.

The cutting device is likewise provided with one or several second screw means (7), which may move the whole of the upper (2) and the lower cutting rail (1) with respect to the cutting knife, in order to be able to symmetrically adjust the upper (2) and the lower cutting rail (1) with respect to the cutting knife. Henceforth, the second screw means (7) will be indicated in this description as the second adjusting spindle (7). Readjusting the second adjusting spindle occurs by turning it, for instance, by means of an adjusting spanner applied to the adapted cross-section (10) (this may be two flattened sides).

In FIG. 2 a particular embodiment of the invention is represented, in which the first adjusting spindles (3) and the second adjusting spindles (7) are carried out as one adjusting spindle (8). The first adjusting spindle part (3) is hollow, so that the second adjusting spindle part (7) may extend through the hollow inner space of the first adjusting spindle (3). At its bottom end, the second adjusting spindle part is provided with screw thread (14), so that when turning the second adjusting spindle part (7) by means of an adjusting spanner which is applied to the adapted cross-section (10), the upper and the lower rail together are moving downwards, enabling the cutting knife to be positioned in the centre of the jaw opening. The first (3) and the second (7) adjusting spindle part are each provided with a clamping device (9) in order to secure their positions and with an adapted cross-section (6, 10) to readjust the jaw.

In case the first (3) and the second (7) adjusting spindles are carried out as one adjusting spindle (8), a choice has to be made which readjusting has to be applied when readjusting the jaw:

- to adapt the height of the jaw;
- to install the cutting knife symmetrically with respect to the jaw.

Depending on the method, the clamping device (9) of the corresponding first (3) or second (7) adjusting spindle part has to be loosened, the adjusting spindle part (3, 7) has to be adjusted along the distance desired by turning the respective adjusting spindle part by applying an adjusting spanner to the adapted cross-section (6, 10) and thereafter to retighten the corresponding clamping device (9).

Both the cutting device represented in FIG. 1 and the one represented in FIG. 2 may be provided with motion detectors, installed on both sides of the cutting device in order to measure either the distance of the upper (2) and the lower (1) cutting rail with respect to the cutting knife or the distance of the upper (2) and lower cutting rail with respect to one another, or both. These measuring signals captured by the position sensor may be displayed within the field of vision of the adjuster. When readjusting an adjusting spindle according to the invention he may be able to read the new height of the jaw (in case the distance between the upper (2) and the lower cutting rail (3) is measured or he may be able to read what will be the new distance between the upper cutting rail (2) and the cutting knife and/or between the lower cutting rail (1) and the cutting knife) (when properly adjusted both these distances should be practically the same). In doing so, he will have a permanent view on the effect of his readjustment and he will be able to stop when the height of the jaw which is desired and therefore the pile height which is desired will be reached. The position sensors used are, for instance, contactless sensors such as, for instance, those using a laser beam.

The first (3) and/or the second (7) adjusting spindle as well as the design in one piece (8) may be driven by one or several electric motor(s). In the process a processor unit may be used, in combination with the signals of the motion detectors, to move the upper (2) and/or the lower cutting rail (1) over the given distance. In doing so, the left and right spindles are preferably synchronically controlled.

To conclude it should be noted that one or several fastening plates (11) are used to rigidly interconnect the upper (2) and the lower cutting rail (1) by means of clamping means (12) and in doing so the forces which are exerted on the upper (2)

and the lower cutting rail (1) during the weaving process will not be transferred to the adjusting spindles (3, 7, 8).

The invention claimed is:

1. Cutting device for a face-to-face weaving machine, comprising a cutting knife and an upper and a lower cutting rail with an adjustable intermediate distance the adjustments made by of one or several screws, wherein the device comprises at least one first screw having a first and a second threaded part having a screw thread mutually opposite and having approximately the same pitch, each threaded part being provided to move the intermediate distance of the respective cutting rails in the opposite directions.

2. Cutting device according to claim 1, wherein the said device comprises at least one second screw means in order to move the upper and the lower cutting rail as a whole, whilst maintaining their intermediate distance.

3. Cutting device for a face-to-face weaving machine, comprising a cutting knife and an upper and a lower cutting rail with an adjustable intermediate distance the adjustments made by of one or several screws, wherein the device comprises at least one first screw having a first and a second threaded part having a screw thread mutually opposite and having approximately the same pitch, each threaded part being provided to move the intermediate distance of the respective cutting rails in opposite directions, wherein the said device comprises at least one second screw means to move the upper and the lower cutting rail as a whole, whilst maintaining their intermediate distance, and wherein the first screw means is made hollow and in that the second screw means extends through a hollow inner space of the first screw means.

4. Cutting device according to claim 2, wherein the device comprises at least one electric motor, which is provided to drive the first and/or the second screw means in order to rotate the first and/or the second screw means to adjust the cutting rails.

5. Cutting device according to claim 1, wherein the said cutting device has been provided with at least one position sensor.

6. Cutting device according to claim 5, wherein the position sensor is a contactless sensor.

7. Cutting device according to claim 6, wherein the contactless sensor measures the position by means of a laser beam.

8. Cutting device according to claim 1, wherein each first and/or the second screw means has been provided with a clamping device to maintain the screw means in the adjusted position.

9. Face-to-face weaving machine comprising a cutting device according to claim 1.

10. Cutting device for a face-to-face weaving machine, comprising a face-to-face weaving machine, a cuffing knife and upper and lower cutting rails with an intermediate distance which may be adjusted by means of one or several screws, wherein the cutting device further comprises at least one first screw having first and second threaded parts having screw threads mutually opposite and having substantially the same pitch, each threaded part being provided to move the respective cutting rails in opposite senses of direction.

11. Cutting device according to claim 10, wherein the said device comprises at least one second screw in order to move the upper and lower cutting rails as a whole, whilst maintaining their intermediate distance.

12. Cutting device according to claim 11, wherein the first screw means is made hollow and the second screw means extends through a hollow inner space of the first screw means.

13. Cutting device according to claim 11, wherein the device comprises at least one electric motor, which is provided to drive the first and/or the second screw to rotate the first and/or the second screws to adjust the cutting rails.

14. Cutting device according to claim 10, wherein the said cutting device has been provided with at least one position sensor.

15. Cutting device according to claim 14, wherein the position sensor is a contactless sensor.

16. Cutting device according to claim 15, wherein the contactless sensor measures the position by means of a laser beam.

17. Cutting device according to claim 10, wherein each first and/or the second screw means has been provided with a clamping device to maintain the screw means in the adjusted position.

18. Face-to-face weaving machine comprising a cuffing device according to claim 10.

* * * * *